US006550149B2

(12) United States Patent
Dowdell

(10) Patent No.: US 6,550,149 B2
(45) Date of Patent: Apr. 22, 2003

(54) METHOD FOR SIZING FEET

(75) Inventor: Mark Dowdell, 777 Leslie Valley Dr., Newmarket, Ontario (CA), L3Y 7K7

(73) Assignee: Mark Dowdell, Nwmarket (CA)

( * ) Notice: Subject to any disclaimer, the term of this patent is extended or adjusted under 35 U.S.C. 154(b) by 0 days.

(21) Appl. No.: 09/844,676

(22) Filed: Apr. 30, 2001

(65) Prior Publication Data

US 2002/0157266 A1 Oct. 31, 2002

(51) Int. Cl.[7] ..... A43D 1/00
(52) U.S. Cl. ..... 33/6; 33/512
(58) Field of Search ..... 33/3 R, 6, 515, 33/512

(56) References Cited

U.S. PATENT DOCUMENTS

| | | | | |
|---|---|---|---|---|
| 1,331,823 A | | 2/1920 | Phillips | |
| 1,725,334 A | * | 8/1929 | Brannock | 33/3 B |
| 4,266,553 A | * | 5/1981 | Faiella | 36/144 |
| 4,395,826 A | * | 8/1983 | Bidegain et al. | 33/3 C |
| 4,522,777 A | * | 6/1985 | Peterson | 36/154 |
| 4,567,617 A | | 2/1986 | Limbach | 12/142 P |
| 4,635,366 A | | 1/1987 | Fohrman et al. | 33/3 B |
| 4,677,766 A | * | 7/1987 | Gudas | 36/43 |
| 4,931,773 A | | 6/1990 | Rosen | 340/573 |
| 4,993,429 A | * | 2/1991 | Krinsky | 33/515 |
| 5,014,041 A | | 5/1991 | Rosen | 340/573 |
| 5,123,169 A | * | 6/1992 | White et al. | 33/3 C |
| 5,128,880 A | | 7/1992 | White | 364/550 |
| 5,206,804 A | | 4/1993 | Thies et al. | 364/401 |

(List continued on next page.)

FOREIGN PATENT DOCUMENTS

| | | |
|---|---|---|
| DE | 198 00 086 A | 7/1999 |
| EP | 1 051 925 A | 11/2000 |

OTHER PUBLICATIONS

Weebok—www.weebok.com/lib/weebokstore/weebok-size.pdf—ChildrenSizeChart –printed Apr. 18, 2001.

KidsNShoes—www.kidsnshoes.com/images/ruler.jpg—The Size Ruler –printed Apr. 2, 2001.

Payless ShoeSource—www.payless.com/corporate/customer_service/custsvc_faq_knowourshoes_shoesizer.html—Kids Shoe Sizer —printed Mar. 3, 2001.

Shoebuy—www.shoebuy.com/customer/charts.shtml—Fitting—printed Apr. 23, 2001.

Nike Shoes—www.nike.com/usa/index.html—Foot Measurement Chart—printed Apr. 23, 2001.

*Primary Examiner*—G. Bradley Bennett
(74) *Attorney, Agent, or Firm*—Timothy J. Sinnott; Bereskin & Parr

(57) ABSTRACT

A system and method for sizing one's feet for shoes, and for the fitting of shoes. The system includes a computer having a fitting program, which receives foot data from a user, and shoe data for a selected shoe from a shoe information database and compares them, determining a fit indicator for each compared property. The foot and shoe data includes the length, the metatarsal length, the width and the heel width. A useful shoe length is calculated by the program based on the shoe length and several modifiers including the elevation of the heel, the thickness of the collar and the shape and height of the toebox. The program also receives a sock type indicator from the user, indicating a selected sock to be worn with the selected shoe, and accounts for the thickness of the selected sock when determining the fit indicator. The system enables a person to determine a shoe fit, without the need for trying on the selected shoe. The foot data received by the program is obtained using a foot sizing chart that can be downloaded and printed by the user from an Internet web site containing the program, or by use of a scanner. Because the user can inadvertently print the chart at an unknown scale, the program can automatically normalize the foot data received from the user, by determining both the horizontal and vertical scale factors at which the chart was printed.

11 Claims, 20 Drawing Sheets

U.S. PATENT DOCUMENTS

| | | | | | |
|---|---|---|---|---|---|
| 5,231,723 | A | | 8/1993 | White et al. | 12/133 R |
| 5,237,520 | A | | 8/1993 | White | 364/560 |
| 5,361,133 | A | | 11/1994 | Brown et al. | 356/376 |
| 5,445,598 | A | | 8/1995 | Nguyen-Senderowicz | 602/65 |
| 5,539,677 | A | | 7/1996 | Smith | 364/560 |
| 5,640,779 | A | * | 6/1997 | Rolloff et al. | 33/512 |
| 5,659,395 | A | | 8/1997 | Brown et al. | 356/376 |
| 5,714,098 | A | | 2/1998 | Potter | 264/40.1 |
| 5,729,905 | A | | 3/1998 | Mathiasmeier et al. | 33/3 R |
| 5,822,223 | A | | 10/1998 | Genest | 364/560 |
| 5,879,725 | A | | 3/1999 | Potter | 425/403 |
| 6,029,358 | A | | 2/2000 | Mathiasmeier et al. | 33/3 R |

* cited by examiner

98

| Sock Type (96) | OA_Length_Add In mm (100) | Met_Length_Add In mm (102) | Met_Width_Add In mm (104) | Heel_Width_Add In mm (106) |
|---|---|---|---|---|
| Standard Socks | 2 | 1 | 2 | 2 |
| Thick Socks | 4 | 2 | 4 | 4 |
| Bare Feet | 0 | 0 | 0 | 0 |

FIG. 4

166

| Toebox Shape (158) | Toebox Height (160) | Percent Usable (168) |
|---|---|---|
| Square | High | 100% |
| Square | Medium | 98% |
| Square | Low | 95% |
| Medium Snubby | High | 98% |
| Medium Snubby | Medium | 97% |
| Medium Snubby | Low | 94% |
| Pointy | High | 95% |
| Pointy | Medium | 92% |
| Pointy | Low | 88% |
| Very Pointy | High | 82% |
| Very Pointy | Medium | 80% |
| Very Pointy | Low | 75% |

FIG. 6

170

| 162 Collar Thickness Indicator | 172 Collar Thickness Factor (mm) |
|---|---|
| Thin (no foam) | 0 |
| Medium Foam | 2 |
| Thick Foam | 5 |

FIG. 7

174

| 164 Heel Elevation Indicator | 176 Percent of OA Length Added |
|---|---|
| Flat Shoe | 0 |
| Low Rise Heel | 1% |
| Medium Rise Heel | 2% |
| High Heel | 4% |

FIG. 8

182 112

| Fit-Type Indicator | Modified Foot Length | Threshold Value #1 | Threshold Value #2 | Threshold Value #3 | Threshold Value #4 |
|---|---|---|---|---|---|
| Snug | Small | 0 | .01 x Modified Foot Length | .05 x Modified Foot Length | .10 x Modified Foot Length |
| Snug | Medium | 0 | .01 x Modified Foot Length | .03 x Modified Foot Length | .085 x Modified Foot Length |
| Snug | Large | 0 | .01 x Modified Foot Length | .03 x Modified Foot Length | .05 x Modified Foot Length |
| Roomy | Small | 0 | .02 x Modified Foot Length | .06 x Modified Foot Length | .13 x Modified Foot Length |
| Roomy | Medium | 0 | .02 x Modified Foot Length | .05 x Modified Foot Length | .10 x Modified Foot Length |
| Roomy | Large | 0 | .02 x Modified Foot Length | .05 x Modified Foot Length | .08 x Modified Foot Length |

FIG. 18

METHOD FOR SIZING FEET

FIELD OF THE INVENTION

The present invention relates to shoe sizing systems and more particularly, the invention relates to shoe sizing systems wherein measurements are taken on the wearer's foot and the selected shoe separately.

BACKGROUND OF THE INVENTION

The sizing of shoes is most commonly performed with the well-known Brannock device. Generally, the Brannock device is a metal foot measuring device that has sliders with scales printed on either the sliders or the platform on which a consumer places his/her foot for sizing. This device, however, has many serious drawbacks. The Brannock device can be difficult to use correctly and is used incorrectly by many within the shoe sales industry. As well, the device is generally used only to measure the length and width of a foot. Also, a person will generally have to visit a shoe store in order to be shoe-sized with the Brannock device.

There has for a long time been a substantial mail order business in many countries for various articles of clothing. An important issue in ordering clothing by mail order is that of sizing. For many articles of clothing, this is not too great a problem, as manufacturers have standard sizes and moreover, an exact fit is not critical. Shoes and other items of footwear present a different problem as it is much more important to get a good fit for shoes, and indeed, incorrectly sized shoes can permanently deform one's feet. This is an even bigger problem with children, as their feet are growing and it is much more important to ensure that young, growing feet are provided the properly sized shoes. Accordingly mail order suppliers have searched for ways to enable consumers to properly select the correct shoe size.

With the growth of the Internet, the concept of mail order purchasing has been significantly revised and improved. There are many companies offering Internet-based services for ordering clothing. A major advantage of the Internet is that a consumer can have almost instantaneous contact with a supplier or web site offering clothing, etc. for sale. The consumer can additionally see images of items for sale on a screen and print out pages from a supplier's web site. Many companies have attempted to use these characteristics to provide improved service to consumers and in particular to address the issue of selecting a correct shoe size.

Several companies, including Weebok™ and Payless Shoe Source™, provide shoe sizing systems on their Internet web sites which are respectively www.weebok.com and www.payless.com/corporate/customer_service/custsvc_faq_knowourshoes_shoesizer.html and nike.com. A consumer with Internet access and a printer, may print a shoe size chart from the web site, and use the chart to size the consumer's feet. This system provides the shoe size chart very quickly, relative to the system described above. However, it often occurs that the shoe sizing chart is inadvertently printed at the incorrect scale. The measurements taken using the chart can therefore be in error due to the scale at which it is printed. The scale can differ in the horizontal and vertical directions.

There exists a need, therefore, for a shoe sizing system that is easy to use and accurate, enabling a consumer to quickly size a shoe without the need for trying on the shoe. Preferably, this should enable the consumer to size a shoe remotely.

SUMMARY OF THE INVENTION

In a first aspect, the present invention relates to a method for determining the fit of a selected shoe, comprising:

obtaining a set of foot measurements including foot length, foot width and foot metatarsal length;

selecting a shoe;

obtaining a set of shoe measurements for the selected shoe, the set of shoe measurements including shoe length, shoe width and shoe metatarsal length;

comparing the shoe measurements with the foot measurements; and generating at least one fit indicator based on the comparison.

In a preferred embodiment of the first aspect, the step of obtaining foot measurements comprises the steps of:

providing a foot sizing chart having an unknown scale;

obtaining a set of raw foot data using the foot sizing chart;

obtaining a set of normalizing information using the foot sizing chart; and calculating the set of foot measurements from the raw foot data and the normalizing information.

In another preferred embodiment of the first aspect, the step of obtaining foot measurements comprises the steps of:

providing a scanner;

obtaining a scanned foot image using the scanner; and determining the foot measurements from the scanned image.

In another preferred embodiment of the first aspect, the shoes and the foot are remote from each other.

In a second aspect, the present invention relates to a method for determining the fit of a selected shoe, comprising:

obtaining a set of foot measurements including foot length, foot width and foot heel width;

selecting a shoe;

obtaining a set of shoe measurements for the selected shoe, the set of shoe measurements including shoe length, shoe width and shoe heel width;

comparing the shoe measurements with the foot measurements; and generating at least one fit indicator based on the comparison.

In a third aspect, the present invention relates to a method for determining the fit of a selected shoe, comprising:

providing a scanner;

obtaining a scanned foot image using the scanner;

determining a set of foot measurements from the scanned image, the set of foot measurements including foot length and foot width;

selecting a shoe;

obtaining a set of shoe measurements for the selected shoe, the set of shoe measurements including shoe length and shoe width;

comparing the shoe measurements with the foot measurements; and generating at least one fit indicator based on the comparison.

In a fourth aspect, the present invention relates to a method for determining the fit of a selected shoe, comprising:

providing a foot sizing chart having an unknown scale;

obtaining a set of raw foot data using the foot sizing chart;

obtaining a set of normalizing information using the foot sizing chart;

calculating a set of foot measurements from the raw foot data and the normalizing information, the set of foot measurements including foot length and foot width;

selecting a shoe;

obtaining a set of shoe measurements for the selected shoe, the set of shoe measurements including shoe length and shoe width;

comparing the shoe measurements with the foot measurements; and generating at least one fit indicator based on the comparison.

DESCRIPTION OF THE DRAWINGS

The present invention will now be described by way of example only, with reference to the drawings in which:

FIG. 4 is a table of Sock Thickness Values;

FIG. 6 is a table of Toebox Shape Values;

FIG. 7 is a table of Collar Values;

FIG. 8 is a table of Heel Elevation Values;

FIG. 18 is a table of values used by a fit indicator subroutine shown in FIG. 2*d.*

DESCRIPTION OF THE PREFERRED EMBODIMENT

Figure 1:
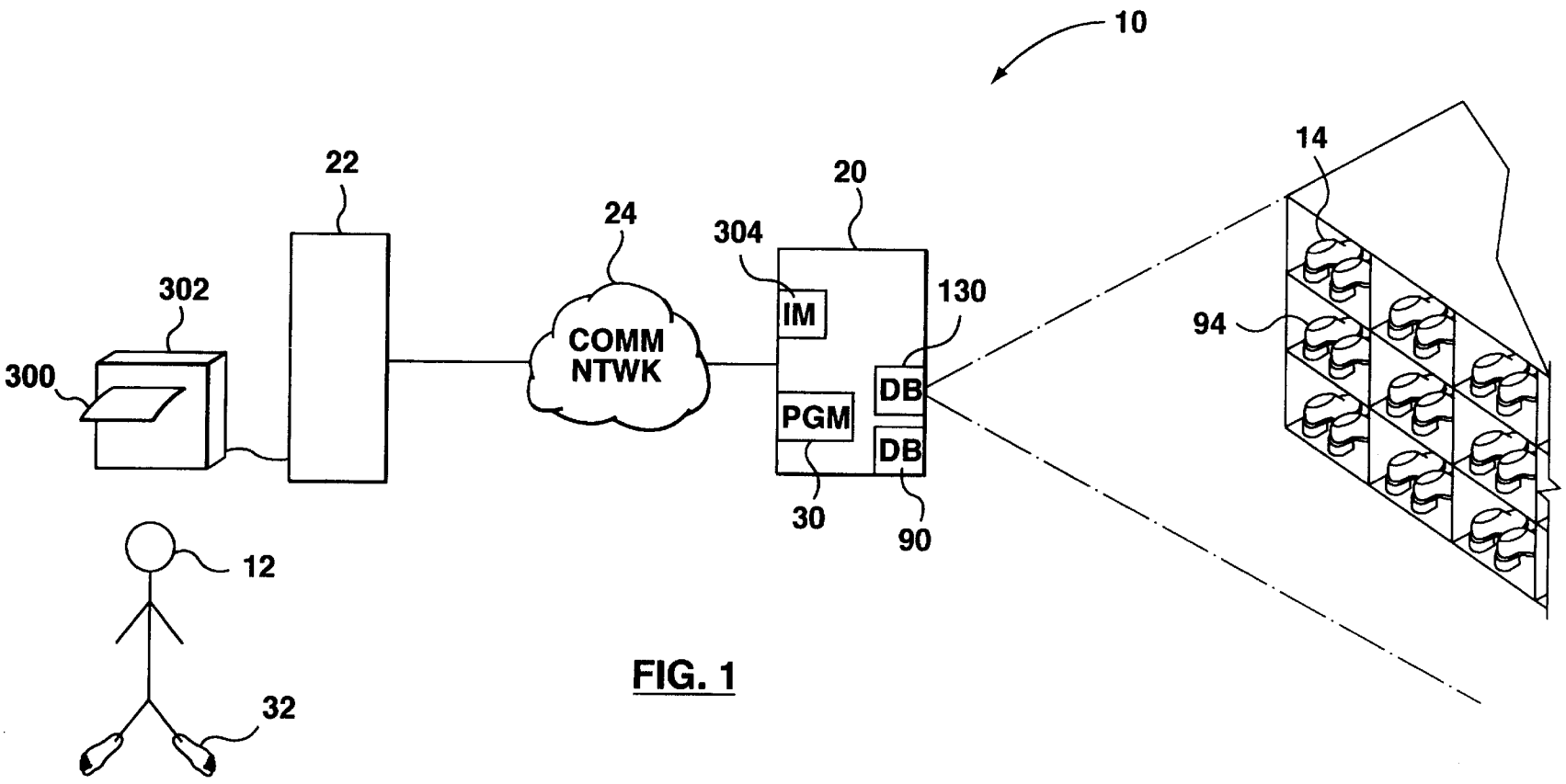
FIG. 1 is a schematic view of a shoe sizing system in accordance with a first preferred embodiment of the present invention.

Reference is first made to FIG. 1, which illustrates a shoe sizing system 10 made in accordance with a first preferred embodiment of the present invention and which will be used for the purposes of describing the operational aspects of the invention. System 10 is used by a user 12 to determine the best fitting shoe and the shoe that most closely meets the needs of user 12, from amongst a group of shoes 14 of different makes, models and sizes.

System 10 includes a fitting computer 20 that communicates with a user computer 22 through a communications network 24, which is preferably the Internet. Using computer 22 and communications network 24, user 12 can access a fitting program 30 that is stored on computer 20, which is used to determine a predicted quality of fit of any selected shoe, from amongst shoes 14 on a foot 32 of user 12, without user 12 having to try on any of shoes 14.

Figure 2A:
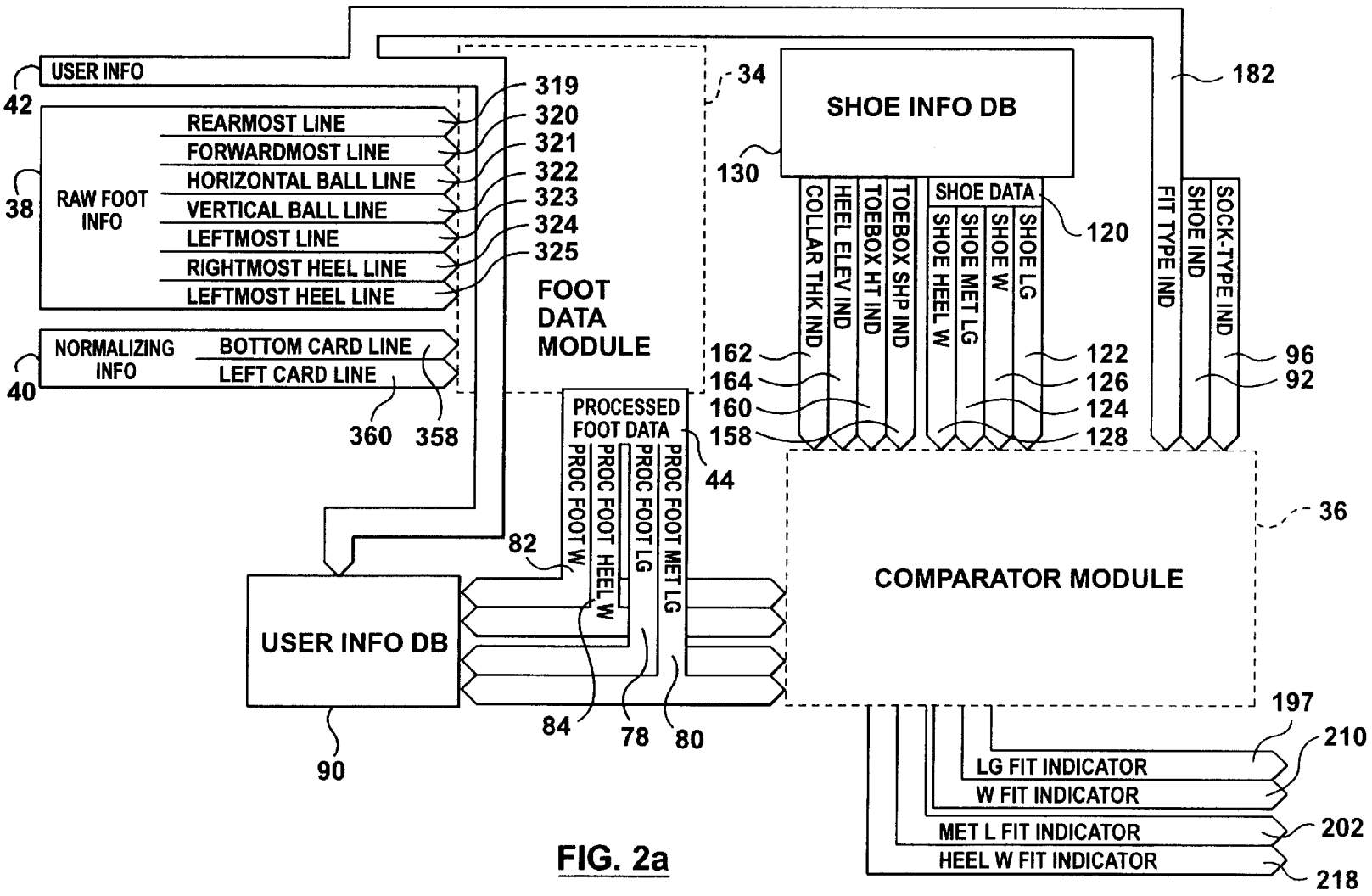
FIG. 2*a* is a block diagram of the program shown in FIG. 1.

Reference is now made to FIG. 2*a*, which illustrates program 30 functionally. Program 30 receives foot data from user 12 of FIG. 1, compares it to shoe data pertaining to a shoe 14, indicating to user 12 the predicted quality of fit of the shoe 14.

Figure 15:
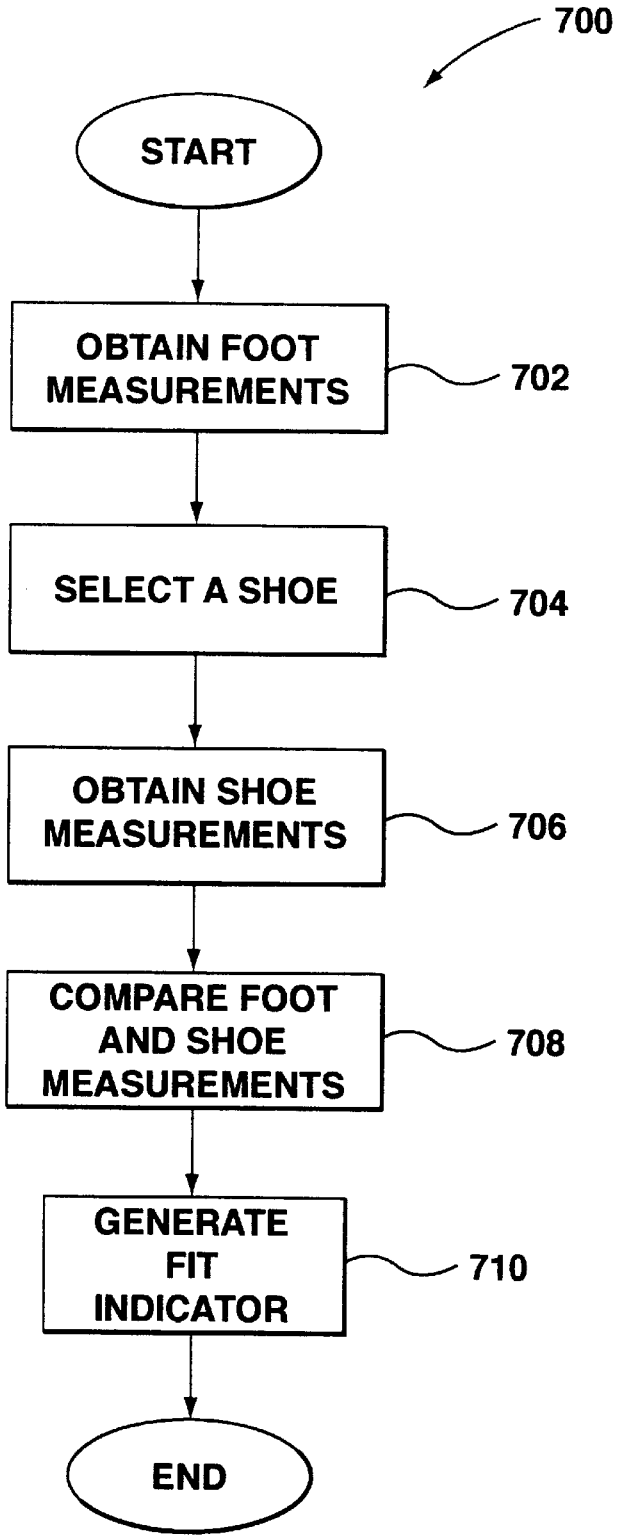
FIG. 15 is a flow diagram illustrating a method of assessing the fit of a selected shoe in accordance with another preferred embodiment of the present invention.

Reference is now made to FIG. 15, which shows a method 700 in accordance with a preferred embodiment of the present invention, by which user 12 can assess the fit of a selected shoe. At step 702, foot measurements are obtained. At step 704, a shoe is selected. At step 706, shoe measurements are obtained for the selected shoe. At step 708, the shoe and foot measurements are compared, and at step 710, at least one fit indicator is generated, based on the comparison.

Referring to FIG. 2*a*, program 30 includes a foot data module 34, and a comparison module 36. At step 702 (FIG. 15), foot data module 34 receives raw foot information 38, normalizing information 40 and user information 42 from user 12, through user computer 22 and communications network 24. Program 30 processes the raw foot information 38, producing processed foot data 44. Raw foot information 38, normalizing information 40 and foot data module 34 are described in more detail further below. Program 30 is shown in detail in FIGS. 2*b*, 2*c* and 2*d* and is described in detail below.

Figure 3:
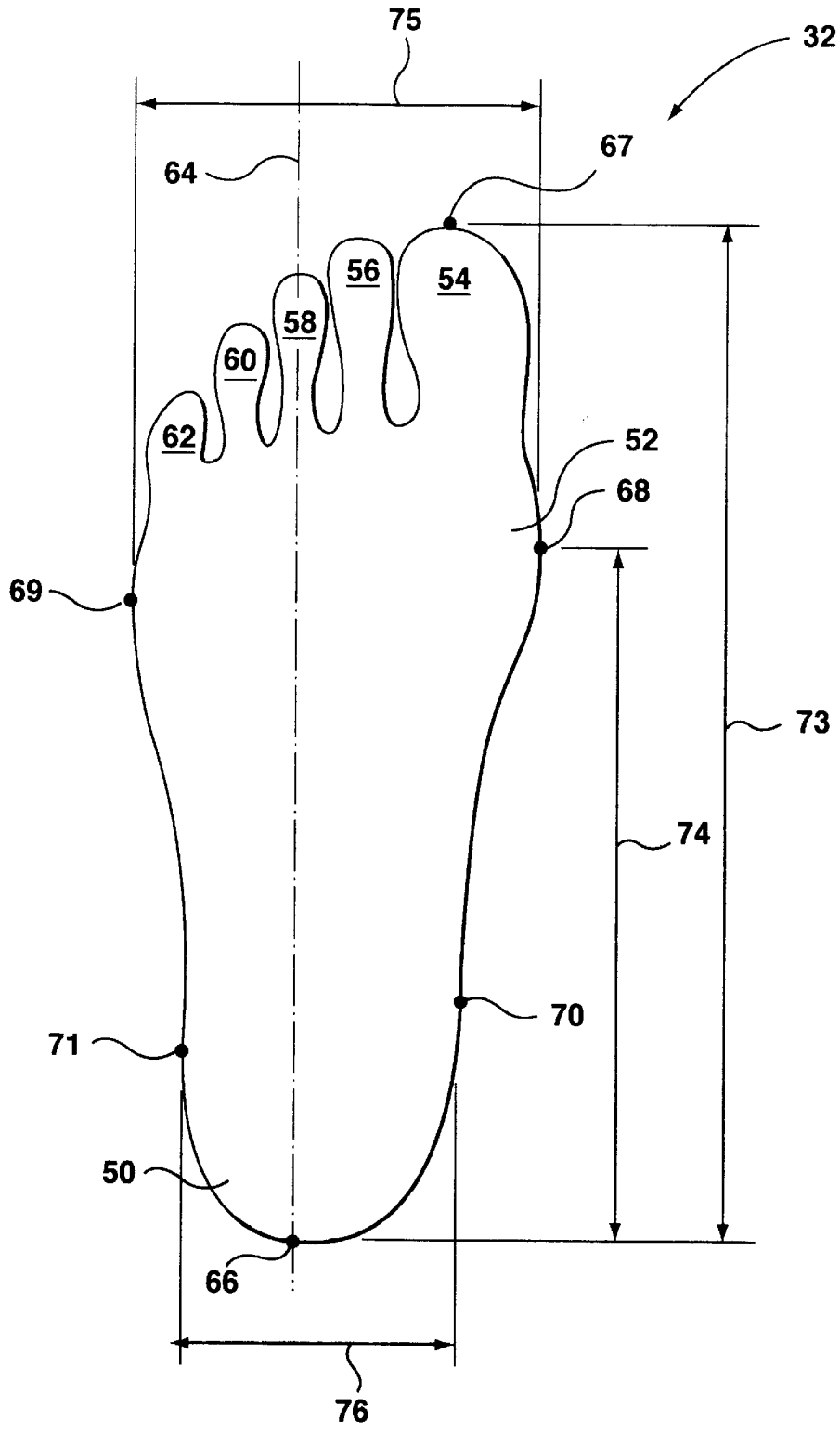
FIG. 3 is a bottom plan view of a foot in FIG. 1.

Reference is now made to FIG. 3, which shows a plan view of the bottom of foot 32, and which will be used to describe processed foot data 44. Foot 32 includes a heel portion 50, a ball 52 and toes 54,56,58,60 and 62. Foot 32 also has a longitudinal axis 64 which is generally parallel to the toes, and particularly, the middle toes 56, 58 and 60.

A rearmost point 66 is the rearmost point on heel 50 in the direction of axis 64. A forwardmost point 67 is the forwardmost point on foot 32 in the direction of axis 64, and is usually found on toe 54 or 56. A ball point 68 is the outermost point on ball 52, in a direction transverse to axis 64. A width point 69 is the outermost point on the opposite side of foot 32 to ball 52, in a direction transverse to axis 64. A rightmost heel point 70 is the outermost point on the right hand side of heel portion 50. A leftmost heel point 71 is the outermost point on the left hand side of heel portion 50.

The length 73 of foot 32 is the distance from the rearmost point 66 to the forwardmost point 67, in a direction parallel to axis 64. The foot metatarsal length 74 is the distance from the ball point 68 to the width point 69 measured in a direction that is transverse to axis 64. The foot width 75 is the length from the rearmost point 66 to ball point 68 in a direction parallel to axis 64. The heel width 76 is the distance between the rightmost heel point 70 and the leftmost heel point 71, in a direction transverse to axis 64.

Figure 2B:
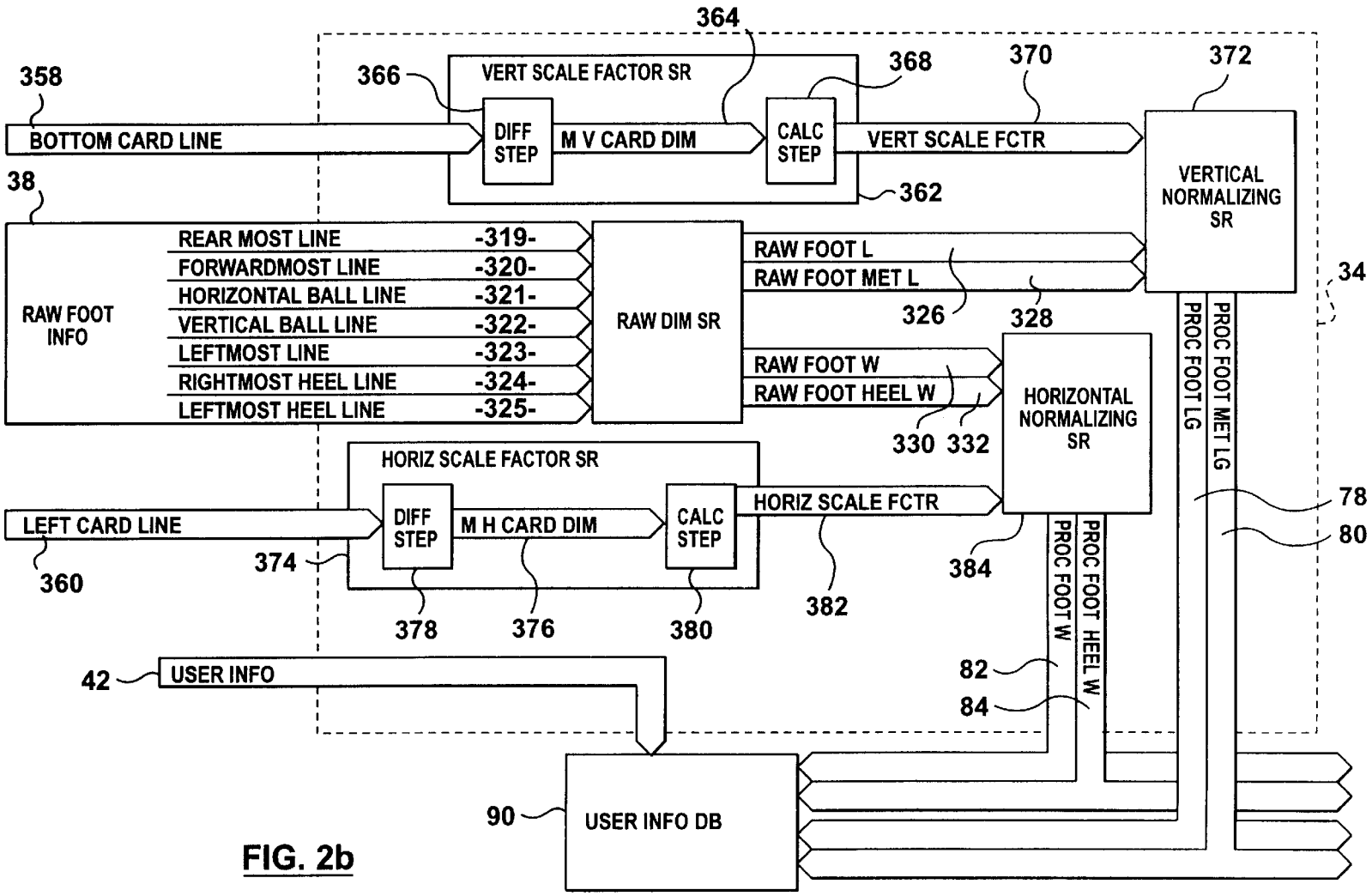
FIG. 2*b* is a block diagram of the foot data module shown in FIG. 2*a;*

Referring to FIG. 2*b*, processed foot data 44 includes a foot length datum 78, a foot metatarsal length datum 80, a foot width datum 82, and a foot heel width datum 84, which correspond to length 73, metatarsal length 74, width 75 and heel width 76 of foot 32. After length and width data 78, 80, 82 and 84 are obtained by foot data module 34, program 30 then stores them in a user information database 90 along with user information 42 for user 12. Because program 30 stores foot data 44 and user information 42 in database 90, user 12 can access the foot information at any later time from database 90 to size shoes.

Figure 2C:
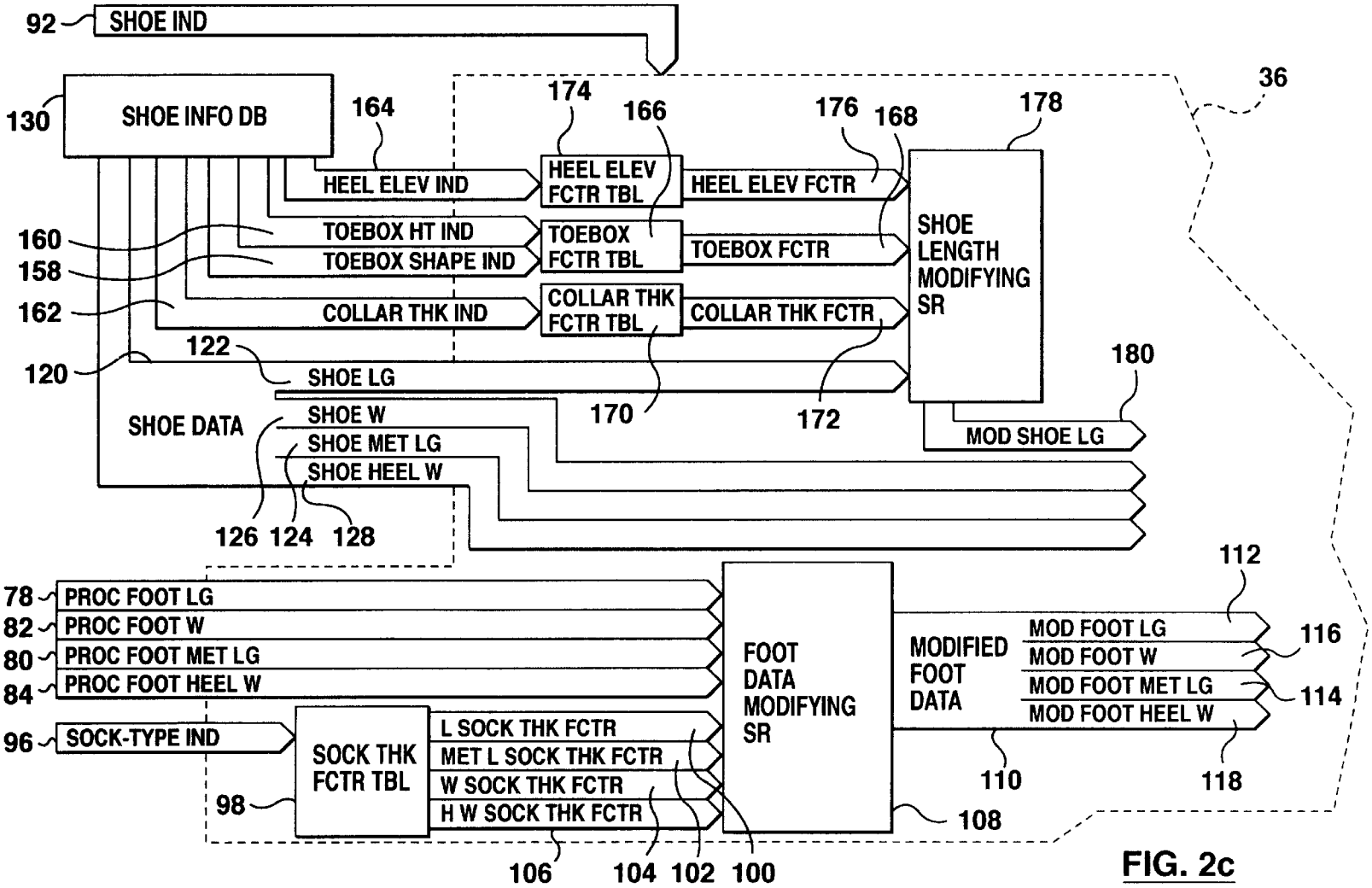
FIG. 2*c* is a block diagram of a portion of the comparison module shown in FIG. 2*a;*
Figure 2D:
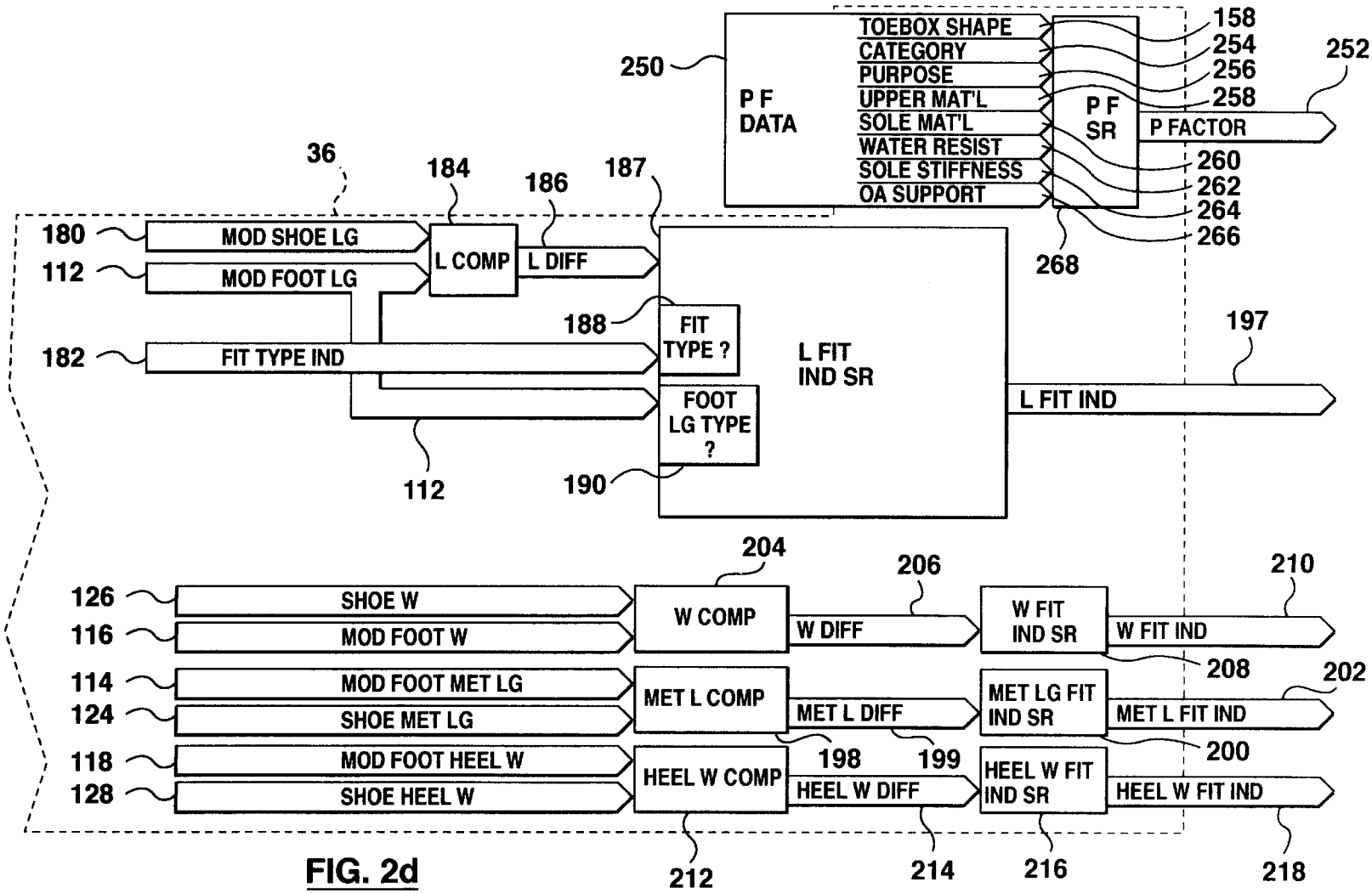
FIG. 2*d* is a block diagram of another portion of the comparison module shown in FIG. 2*a;*

Foot data module 34 also sends foot data 44 to comparison module 36, as shown in FIGS. 2*c* and 2*d*. Comparison module 36 retrieves shoe information from a database, adjusts the foot and shoe information based on various factors which are explained below, compares the adjusted foot and shoe information to determine the fit, and outputs the determination.

At step 704, (FIG. 15), comparison module 36 receives from user 12, a shoe selection indicator 92 identifying a selected shoe. The selected shoe is referred to as shoe 94, as shown in FIG. 1. Module 36 also receives a sock-type indicator 96 from user 12, indicating the type of sock user 12 intends to wear with selected shoe 94.

Comparison module 36 first looks up sock-type indicator 96 in a sock thickness factor table 98, shown in FIG. 4, to obtain four sock thickness factors. The sock thickness factors include a sock thickness factor 100 for foot length, a sock thickness factor 102 for foot metatarsal length, a sock thickness factor 104 for foot width and a sock thickness factor 106 for foot heel width. Program 30 then sends processed foot data 44 and sock thickness factors 100, 102, 104 and 106 to a foot data modifying subroutine 108, that produces modified foot data 110, which are the processed foot data 44 of FIG. 2*b*, modified by an amount proportional to the sock thickness factors, in accordance with the following formulae:

Modified Foot Length 112=foot length 78+sock thickness factor 100

Modified foot metatarsal length 114=foot metatarsal length 80+sock thickness factor 102

Modified foot width 116=foot width 82+sock thickness factor 104

Modified foot heel width 118=foot heel width 84+sock thickness factor 106

At step 706, (FIG. 15), comparison module 36 retrieves shoe data 120 including a shoe length datum 122, a shoe metatarsal length datum 124, a shoe width datum 126 and a shoe heel width datum 128, pertaining to selected shoe 94, from a shoe information database 130.

Shoe information database 130 includes information on many shoes 14, including shoes of various different makes, models, and sizes. Shoe information database 130 is preferably stored on fitting computer 20, but may alternately be stored in another location (eg. on a remote computer connected to network 24, and that is regularly updated with new shoe information). Each shoe 14 is measured for information pertinent to sizing, and the data is stored in database 130.

Figure 5A:
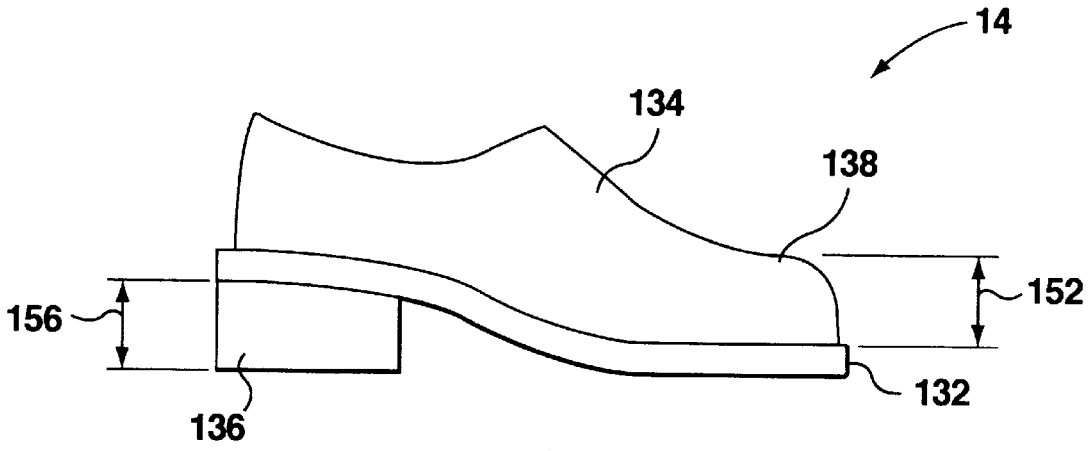
FIG. 5*a* is a side elevation view of a shoe.
Figure 5B:
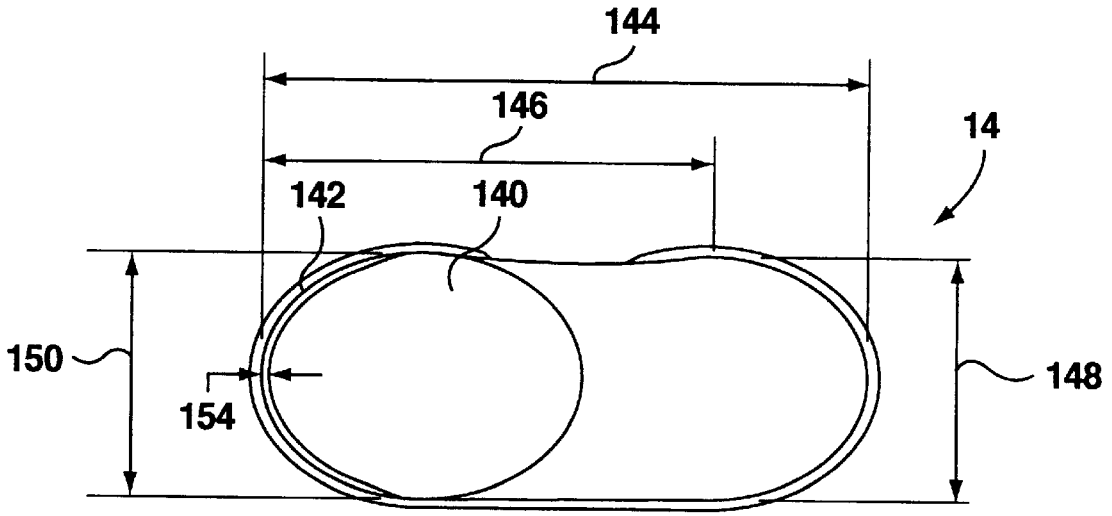
FIG. 5*b* is a top plan view of the shoe shown in FIG. 5*a;*

The information measured is illustrated in FIGS. 5*a* and 5*b*, which show two views of a shoe 14. Shoe 14 has a sole 132, on which is mounted an upper 134. Under sole 132 at the rear of shoe 14 is mounted a heel 136. The front of shoe 14 is the toebox 138, and at the rear is the opening 140. Surrounding the opening 140 is the collar 142.

The information measured includes shoe length 144, shoe metatarsal length 146, shoe width 148, and shoe heel width 150. While these lengths and widths provide helpful sizing information for a shoe, several other properties of a shoe can have an impact on the fit, effectively increasing or decreasing the useful length of the shoe. Such factors include the shape of the toebox 138, including its pointiness, the height 152 of the toebox 138, the thickness 154 of the collar 142, and the elevation 156 of the heel 136. Therefore, database 130 also stores for each shoe 14 a toebox shape indicator 158, a toebox height indicator 160, a collar thickness indicator 162 and a heel elevation indicator 164, and program 30 also draws in these indicators to help predict the quality of fit of selected shoe 94.

Referring again to FIG. 2*c*, program 30 looks up toebox shape indicator 158 and toebox height indicator 160 in a toebox factor table 166, shown in FIG. 6, to obtain a toebox factor 168. Toebox factor 168 is a multiplier factor that reduces the effective length of a shoe, based on the shape and height of the toebox 138. The range of shape indicators 158, includes: square, medium snubby, pointy and very pointy. The range of height indicators 160 includes: high, medium and low. Thus, if the toebox 138 is low and pointy, as is the case, for example on a typical high-heel pump, the toebox factor 168 generated by table 166 is 88%. It should be noted that the shape and height indicators 158 and 160 provided above are for example only, and it will be clear to one skilled in the art that the ranges can be further divided and defined as necessary.

Program 30 looks up collar thickness indicator 162 in a collar thickness factor table 170, shown in FIG. 7, to obtain a collar thickness factor 172. Program 30 looks up heel elevation factor 164 in a heel elevation factor table 174, shown in FIG. 8, to obtain a heel elevation factor 176.

At step 708, (FIG. 15), the shoe and foot measurements are compared as follows. Referring again to FIG. 2*c*, program 30 then sends shoe length datum 122 and factors 168, 172, and 176 to a shoe length modifying subroutine 178 that modifies shoe length datum 122, producing a modified shoe length 180, using the following formula:

Modified shoe Length 180=(shoe length 122+heel elevation factor 176)×toebox factor 168−collar thickness factor 172

Reference is now made to FIG. 2*d*, which shows another portion of comparison module 36. The modified foot length 112, the modified shoe length 180 and a fit-type indicator 182, received by program 30 from user 12 as part of user information 42, are sent to a length comparator step 184 which compares the lengths 112 and 180 by subtracting the modified foot length 112 from the modified shoe length 180 to obtain a length difference datum 186, which corresponds to a length difference in millimeters.

Fit-type indicator 182 indicates the snugness of fit desired by user 12. Two choices exist for indicator 182: snug, and 'roomy'.

At step 710, (FIG. 15), fit indicators are generated as follows. Comparison module 36 sends length difference datum 186, fit-type indicator 182 and modified foot length 112 to a length fit indicator subroutine 187. Subroutine 187 performs a check step 188, where fit-type indicator 182 is checked. Subroutine 187 also performs a second check step 190 where a size category is determined for modified foot length 112. If modified foot length 112 is less than 130 mm, the size category is 'small'. If modified foot length 112 is greater than or equal to 130 mm and less than 180 mm, the size category is 'medium'. If modified foot length 112 is greater than or equal to 180 mm, the size category is 'large'.

Subroutine 187 generates a length fit indicator 197 based on where length difference datum 186 falls within a series of threshold values. For example, for the preferred embodiment discussed here, four threshold values are used. If datum 186 is less than the first threshold value, then length fit indicator 197 is 'too small'. If datum 186 falls between the first and second threshold value, then length fit indicator 197 is 'snug'. If datum 186 is between the second and third values, then indicator 197 is 'good'. If datum 186 is between the third and fourth values, then indicator 197 is 'roomy'. If datum 186 is greater than the fourth value, then indicator 197 is 'too large'. It will be noted that other numbers of threshold values can be used, generating indicators that are more or less precise.

Subroutine 187 utilizes different threshold values, depending on the fit-type indicator 182 and the length of foot 32. The threshold values used for the preferred embodiment described can be found in FIG. 18. It will be noted that other threshold values can also be used.

The modified foot metatarsal length 114 and the shoe metatarsal length 124 are sent to a metatarsal length comparator step 198 which compares the metatarsal lengths 114 and 124 by subtracting the modified foot metatarsal length 114 from the shoe metatarsal length 124 to obtain a metatarsal length difference datum 199, which corresponds to a metatarsal length difference in millimeters. Comparison module 36 then sends the metatarsal length difference 199 to a metatarsal length fit indicator subroutine 200, which generates a metatarsal length fit indicator 202 based on where the metatarsal length difference 199 falls in a range of threshold values, in a manner similar to that for length fit indicator 197. Subroutine 200, however, does not, in the present embodiment, adjust the threshold values based on any conditions. Subroutine 200 can use any suitable threshold values, such as, for example, those disclosed below:

If metatarsal length difference 199 is less than −5 mm, then metatarsal length fit indicator 202 indicates to user 12 that the shoe's metatarsal length is too small. If metatarsal length difference 199 is greater than or equal to −5 mm, and less than 6 mm, then metatarsal length fit indicator 202 indicates to user 12 that the shoe's metatarsal length is a bit short, but acceptable. If metatarsal length difference 199 is greater than or equal to 6 mm, and less than 18 mm, then metatarsal length fit indicator 202 indicates to user 12 that the shoe's metatarsal length is good. If metatarsal length difference 199 is greater than or equal to 18 mm, then metatarsal length fit indicator 202 indicates to user 12 that the shoe's metatarsal length is too long.

The modified foot width 116 and the shoe width 126 are sent to a width comparator step 204 which compares the widths 116 and 126 by subtracting the modified foot width 116 from the shoe width 126 to obtain a width difference datum 206, which corresponds to a width difference in millimeters. Comparison module 36 then sends the width difference 206 to a width fit indicator subroutine 208, which generates a width fit indicator 210 based on where the width difference 206 falls in a range of threshold values, in a manner similar to that for metatarsal length fit indicator 202. Subroutine 208 can use any suitable threshold values, such as, for example, those disclosed below:

If width difference 206 is less than 0 mm, then width fit indicator 210 indicates to user 12 that the shoe's width is too small. If width difference 206 is greater than or equal to 0 mm, and less than 3 mm, then width fit indicator 210 indicates to user 12 that the shoe's width is acceptable. If width difference 206 is greater than or equal to 3 mm, and less than 17 mm, then width fit indicator 210 indicates to user 12 that the shoe's width is good. If width difference 206 is greater than or equal to 17 mm, then width fit indicator 210 indicates to user 12 that the shoe's width is too big.

The modified foot heel width 118 and the shoe heel width 128 are sent to a heel width comparator step 212 which first compares the heel widths 118 and 128 by subtracting the modified foot heel width 118 from the shoe heel width 128 to obtain a heel width difference datum 214, which corresponds to a heel width difference in millimeters. Comparison module 36 then sends the width difference 214 to a width fit indicator subroutine 216, which generates a width fit indicator 218 based on where the width difference 214 falls in a range of threshold values, in a manner similar to that for metatarsal length fit indicator 202. Subroutine 216 can use any suitable threshold values, such as, for example, those disclosed below:

If heel width difference 214 is less than −1 mm, then heel width fit indicator 218 indicates to user 12 that the shoe's heel width is too small. If heel width difference 214 is greater than or equal to −1 mm, and less than 6 mm, then heel width fit indicator 218 indicates to user 12 that the shoe's heel width is acceptable. If heel width difference 214 is greater than or equal to 6 mm, and less than 20 mm, then heel width fit indicator 218 indicates to user 12 that the shoe's heel width is good, and perhaps a little roomy. If heel width difference 214 is greater than or equal to 20 mm, then heel width fit indicator 218 indicates to user 12 that the shoe's heel width is too big.

Once the fit indicators 197, 202, 210 and 218 are calculated, program 30 outputs them, displaying them to user 12 on computer 22, through communications network 24.

As well, program 30 may display other information for shoe 94, such as the make, model, available colours, and other pertinent data that are stored or derived by program 30 from shoe information database 130, to help user 12 in making a purchasing decision. Such information includes play factor data 250, which are drawn in by program 30 from database 130 to calculate a play factor 252. Play factor 252 indicates the usefulness of shoe 94 for a child to play in. Play factor data 250 comprise a shoe category datum 254 (e.g athletic), a shoe purpose datum 256 (e.g. basketball), an upper material datum 258, a sole material datum 260, a datum 262 indicating the level of water resistance of shoe 94, a datum 264 indicating the stiffness of the sole 132, a datum 266 indicating the level of overall support, and the toebox shape indicator 158. From these data, play factor 252 is calculated for shoe 94 in play factor subroutine 268.

Figure 9:
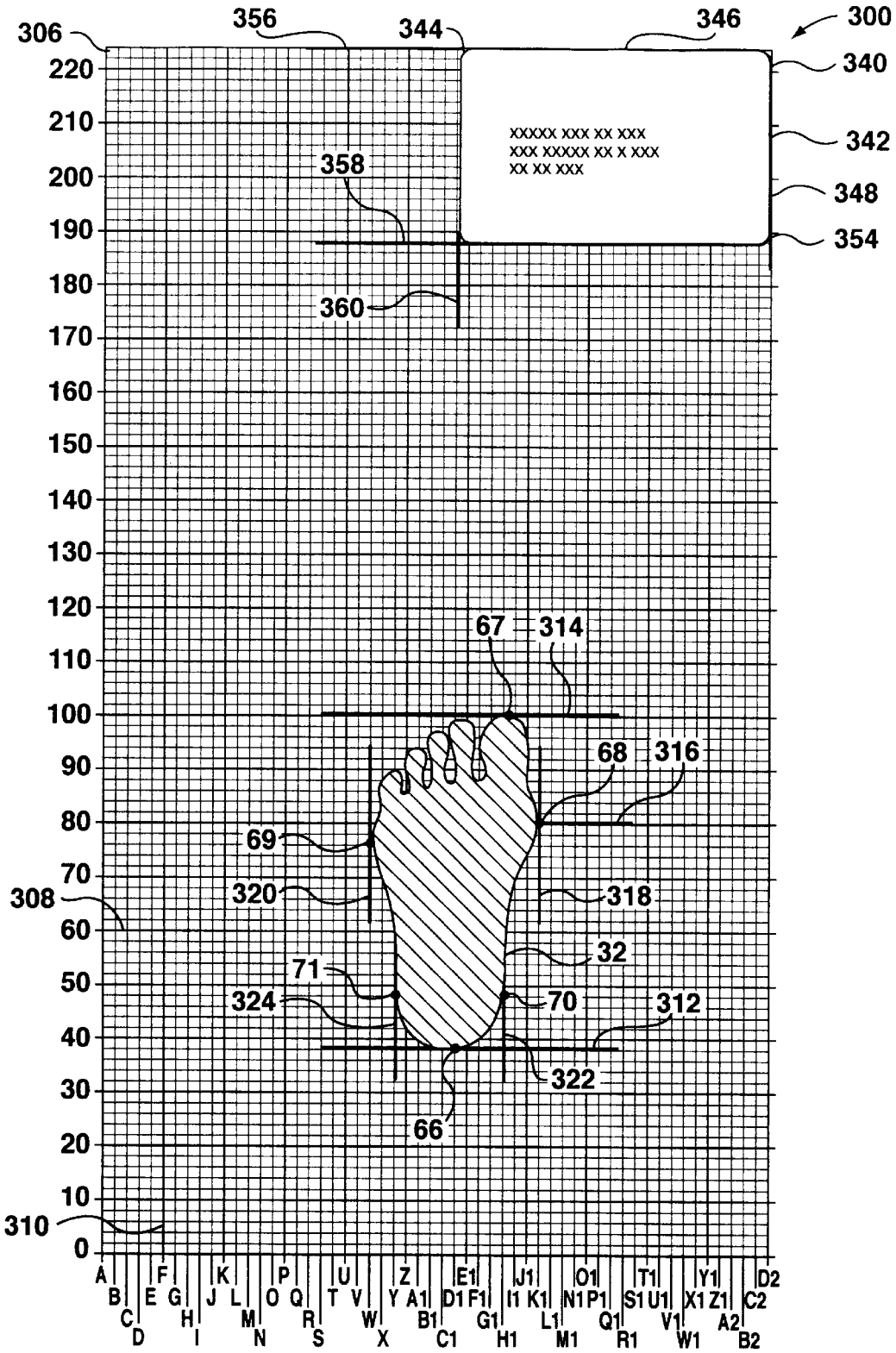
FIG. 9 is a plan view of a foot sizing chart.
Figure 16:
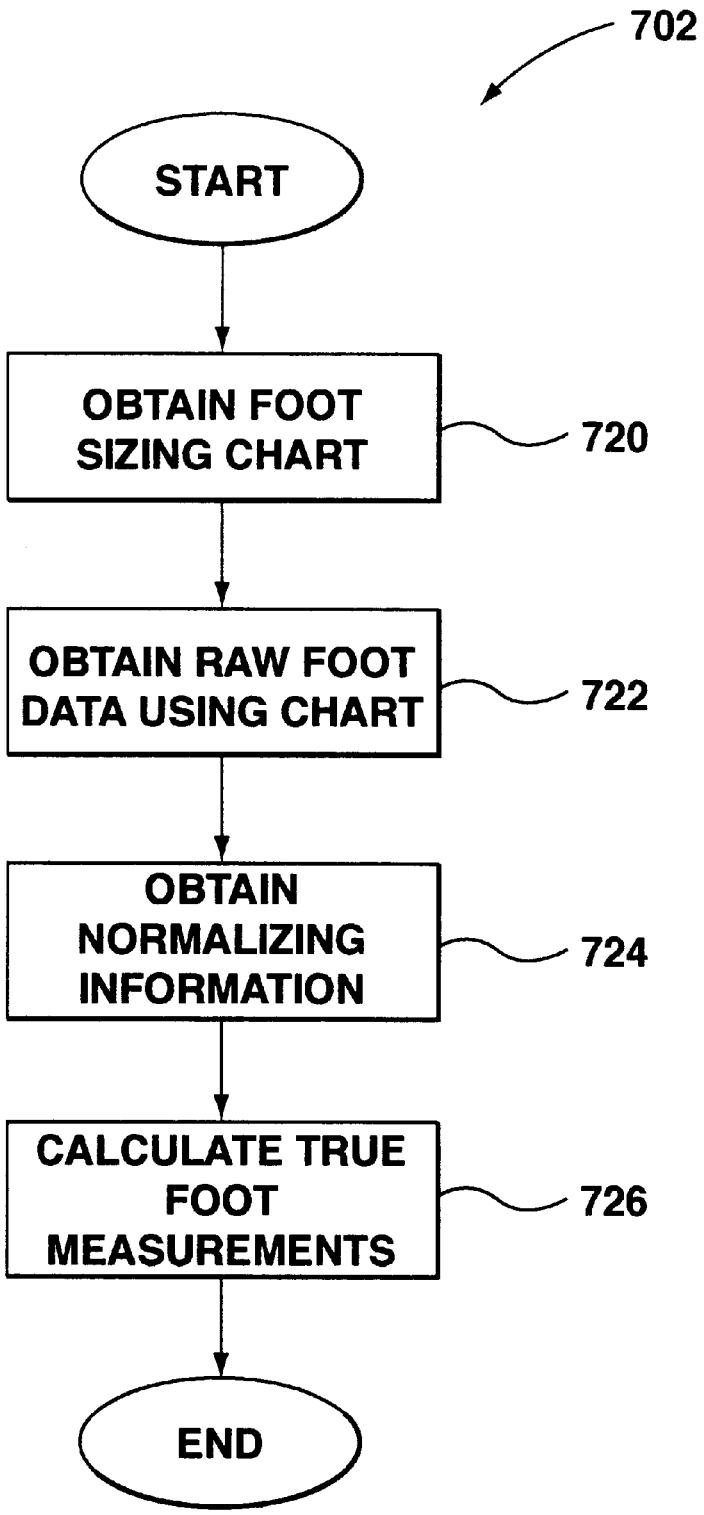
FIG. 16 is a flow diagram of the substeps of the foot measurement obtaining step of FIG. 15.

Referring back to the raw foot information 38, (FIGS. 2*a* and 2*b*), received by program 30 from user 12, the raw foot information 38 is obtained using a foot sizing chart 300, shown in detail in FIG. 9. Step 702, (FIG. 15), wherein the foot measurements are obtained, can be further described as shown in FIG. 16. At step 720, user 12 obtains chart 300. At step 722, raw foot data 38 is obtained using chart 300. At step 724, normalizing information 40 is obtained. At step 726, true foot data are calculated, based on the raw foot data 38 and the normalizing information 40.

At step 720, foot sizing chart 300 is printed using a printer 302, (shown in FIG. 1), from a foot sizing chart image 304 that user 12 can download from fitting computer 20.

Reference is now made to FIG. 9, which shows foot sizing chart 300. Chart 300 includes a measurement area 306 which is made up of a series of horizontal graduations 308 and vertical graduations 310.

At step 722, (FIG. 16), user 12 uses chart 300 to obtain raw foot data 38. To use chart 300, user 12 places chart 300 on a hard surface, such as an uncarpeted floor. User 12 then places his/her foot 32 on measurement area 306 so that measurement area 306 encompasses the entire outline of foot 32 ensuring that axis 64 of foot 32 is parallel to the vertical graduations 310. User 12 then records the number of the horizontal graduation 308 closest to the rearmost point 66 of the heel portion 50 of foot 32. This rearmost horizontal graduation is identified in FIG. 9 as line 312. User 12 then identifies the graduation 308 closest to the forwardmost point 67 of foot 32, which is identified as line 313. For ball point 68, both the nearest horizontal and the nearest vertical graduations 308 and 310 are recorded, and are identified as lines 314 and 315 respectively. The vertical graduation 310 closest to the width point 69 of foot 32 is identified as line 316. Similarly, a rightmost heel line 317 and a leftmost heel line 318 are the vertical lines closest to the rightmost and leftmost points 70 and 71 of heel portion 50.

Reference is now made to FIG. 2*b*, which illustrates foot data module 34 functionally. Raw foot information 38 is made up of data 319, 320, 321, 322, 323, 324 and 325, which correspond to the values of lines 312, 313, 314, 315, 316, 317 and 318 respectively. These data are entered into foot data module 34 of program 30. Foot data module 34 calculates a raw foot length 326, a raw foot metatarsal length 328, a raw foot width 330 and a raw foot heel width 332 using raw foot information 38, in a raw dimension subroutine 334.

Because of differences in settings on different user computers, there is a possibility that chart 300 can inadvertently be printed at an incorrect scale. Thus, at step 724, program 30 obtains normalizing information 40, which is information describing the scale at which chart 300 was printed, so that program 30 can adjust raw dimensions 326, 328, 330 and 332 which were calculated from raw foot data 38, obtained using chart 300. It should be noted that the scale at which chart 300 is printed may differ in the vertical and horizontal directions, depending on the settings of the individual computer from which chart 300 was printed. Thus, normalizing information 40 includes information on both the horizontal scale and the vertical scale so that program 30 can properly adjust or normalize the data.

Figure 10:
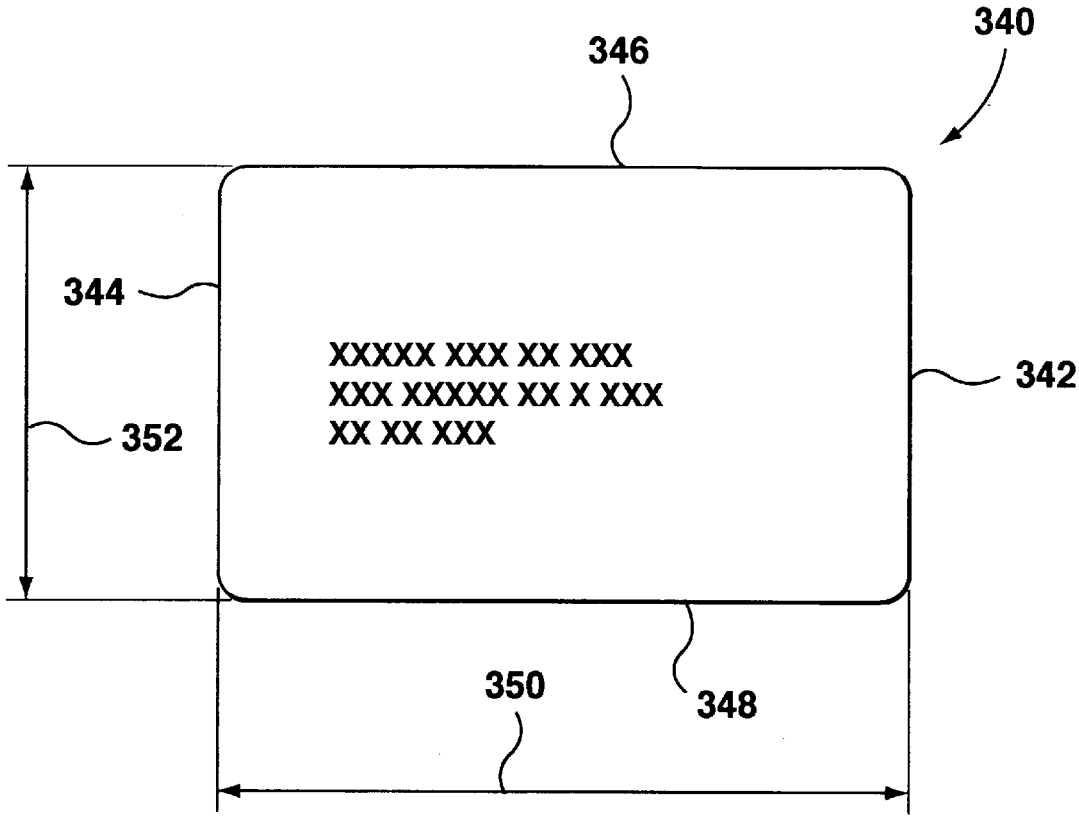
FIG. 10 is a plan view of a credit card.

Reference is now made to FIG. 10, which shows a reference item, such as for example, a credit card or other financial institution card 340, from which normalizing information 40 is obtained. Card 340 has a right edge 342, a left edge 344, a top edge 346 and a bottom edge 348, and has standardized, known dimensions 350 and 352 along the horizontal and vertical axes.

Referring back to FIG. 9, card 340 is placed in the upper right hand corner of measuring area 306, so that edges 342 and 346 align with the rightmost vertical graduation 354 and topmost horizontal graduation 356 respectively. The horizontal graduation nearest bottom edge 348 of card 340 is identified as bottom card line 358. The vertical graduation nearest left edge 344 is identified as left card line 359. Data 360 and 361, representing the values of lines 358 and 359, are inputted into program 30 and make up normalizing information 40.

At step 726, true foot data are calculated using the normalizing data 40 and the raw foot data 38. Referring back to FIG. 2*b*, bottom card line data 358 is sent to a vertical scale factor subroutine 362. A measured vertical card dimension 364 is first calculated in difference step 366, as the difference between the values of topmost horizontal line 356 and datum 358. Dimension 364 is then sent to a calculation step 368, where a vertical scale factor 370 is calculated as the ratio of the known vertical dimension 352 of card 340, (which is permanently stored in subroutine 362), to the measured vertical card dimension 364.

Comparison module 36 then sends vertical scale factor 370, raw foot length 326 and raw foot metatarsal length 328 to a vertical normalizing subroutine 372, where raw foot length 326 is multiplied by vertical scale factor 370 to obtain processed foot length 78. Similarly, raw foot metatarsal length 328 is multiplied by vertical scale factor 370 to obtain processed foot metatarsal length 80.

For the calculation of a horizontal scale factor, left card line datum 359 is sent to a horizontal scale factor subroutine 374, where a measured horizontal card dimension 376 is first calculated in difference step 378, as the difference between the values of rightmost vertical line 354 and left card line datum 359. Dimension 376 is then sent to a calculating step 380, where a horizontal scale factor 382 is calculated as the ratio of the known horizontal dimension 350 of card 340, (which is permanently stored in subroutine 374), to the measured horizontal card dimension 376.

Comparison module 36 then sends horizontal scale factor 382, raw foot width 330 and raw foot heel width 332 to a horizontal normalizing subroutine 384, where raw foot width 330 is multiplied by horizontal scale factor 382 to obtain processed foot width 82. Similarly, raw foot heel width 332 is multiplied by horizontal scale factor 382 to obtain processed foot heel width 84.

Processed foot dimensions 78, 80, 82 and 84 make up processed foot data 44, which is sent to user information database 90 and comparison module 36 as described above.

Figure 11:
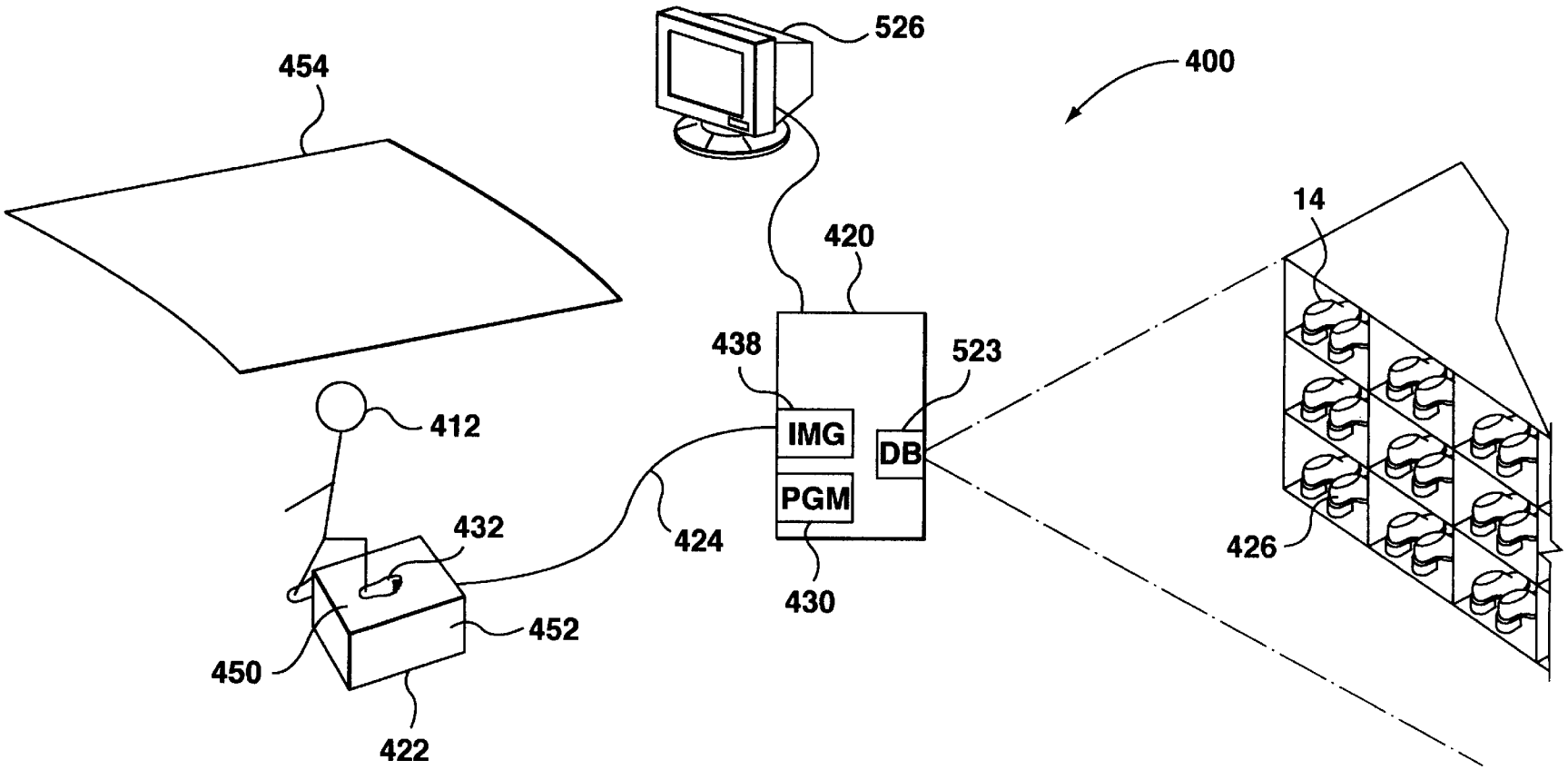
FIG. 11 is a schematic view of a shoe sizing system in accordance with a second preferred embodiment of the present invention.
Figure 17:
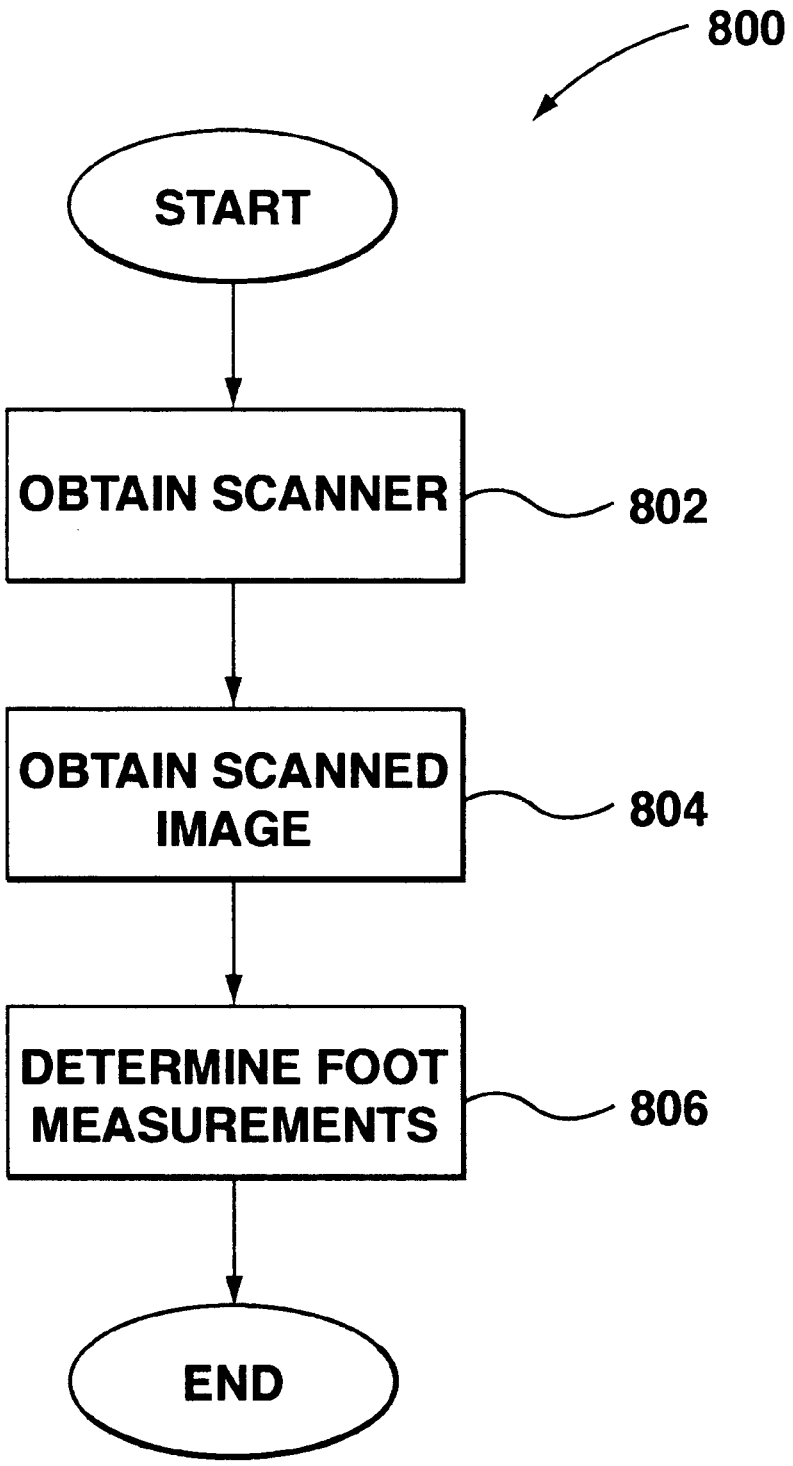
FIG. 17 is a flow diagram of an alternate set of sub steps for obtaining foot measurements in accordance with another preferred embodiment of the present invention.

Reference is now made to FIG. 11 which illustrates a shoe sizing system 400 made in accordance with another preferred embodiment of the present invention. System 400 is used by user 12 to measure foot 32 and to determine the best fitting shoe from amongst the group of shoes 14 of different makes, models and sizes. System 400, however, automates the foot measuring step 702 (FIG. 15). Reference is also made to FIG. 17, which shows an alternate method 800, in accordance with another preferred embodiment of the present invention, which uses system 400 for determining the foot measurements.

At step 802, system 400 is obtained, and includes a fitting computer 420 that communicates with a flatbed scanner 422 through a cable 424. Using system 400, user 12 can obtain a digital image of a foot 32, which is inputted to a program 430 on computer 420 to determine a predicted quality of fit for a selected shoe 426.

At step 804, scanner 422 is used to scan the foot 32 of user 12, producing a scanned foot image 438, which is sent to computer 420, through cable 424. Scanner 422 has a scanning surface 450, which is attached to a housing 452. Scanning surface 450 and housing 452 are strong enough to support the weight of user 12. Preferably, scanner 422 is designed to support a weight of at least 500 pounds, however a lower weight limit is acceptable as well, depending on the type of user that will be the target market for system 400. Above scanning surface 450 is a white background 454, which helps to enhance contrast between the background and the portion of image 438 covered by foot 32. A higher contrast helps program 430 determine where foot 32 ends.

While background 454 has been shown in FIG. 11 to be above the head of user 412, a background can alternately be located just above foot 432, to eliminate further 'noise' in image 438, caused by the body of user 412. Preferably, such a background can be located as low as is practical, for example, just above the ankle of user 412. Such an alternate background can include a leg hole, and can be split at the leg hole. Thus, the background can be opened up, so that user 412 can place their foot 432 on the scanner surface 450, and the background can then be closed around the leg of user 412.

Figure 12:
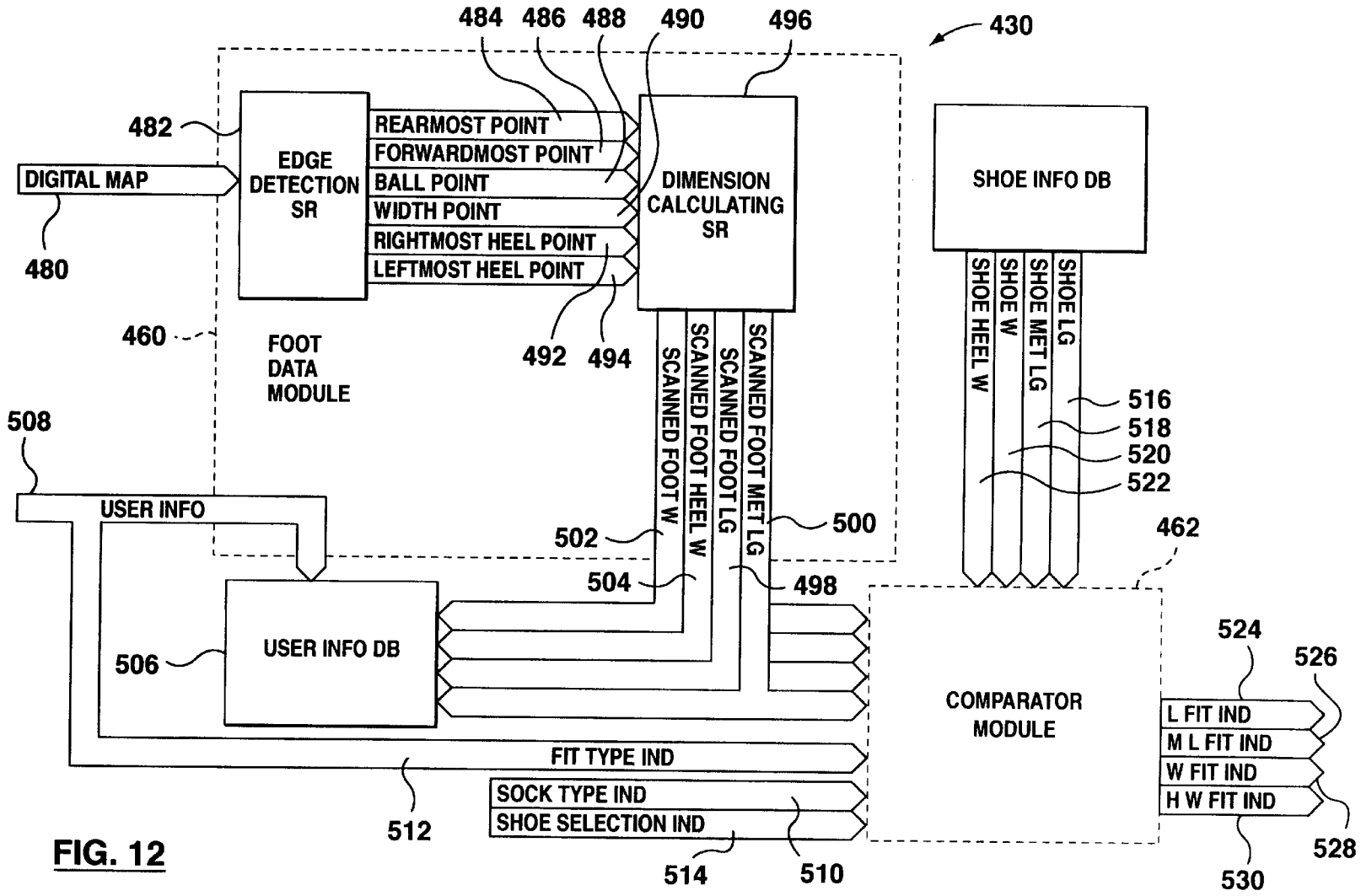
FIG. 12 is a block diagram of an alternate foot data module for use with the system shown in FIG. 11.

At step 806 (FIG. 17), foot measurements are derived using the scanned image 438. Reference is now made to FIG. 12, which shows program 430 for use with system 400 to fit user 12 with shoes. Similarly to program 30, program 430 includes a foot data module 460 and a comparison module 462. Foot data module 460 prompts user 12 to scan foot 32 using scanner 422, and receives the scanned foot image 438.

Figure 13:
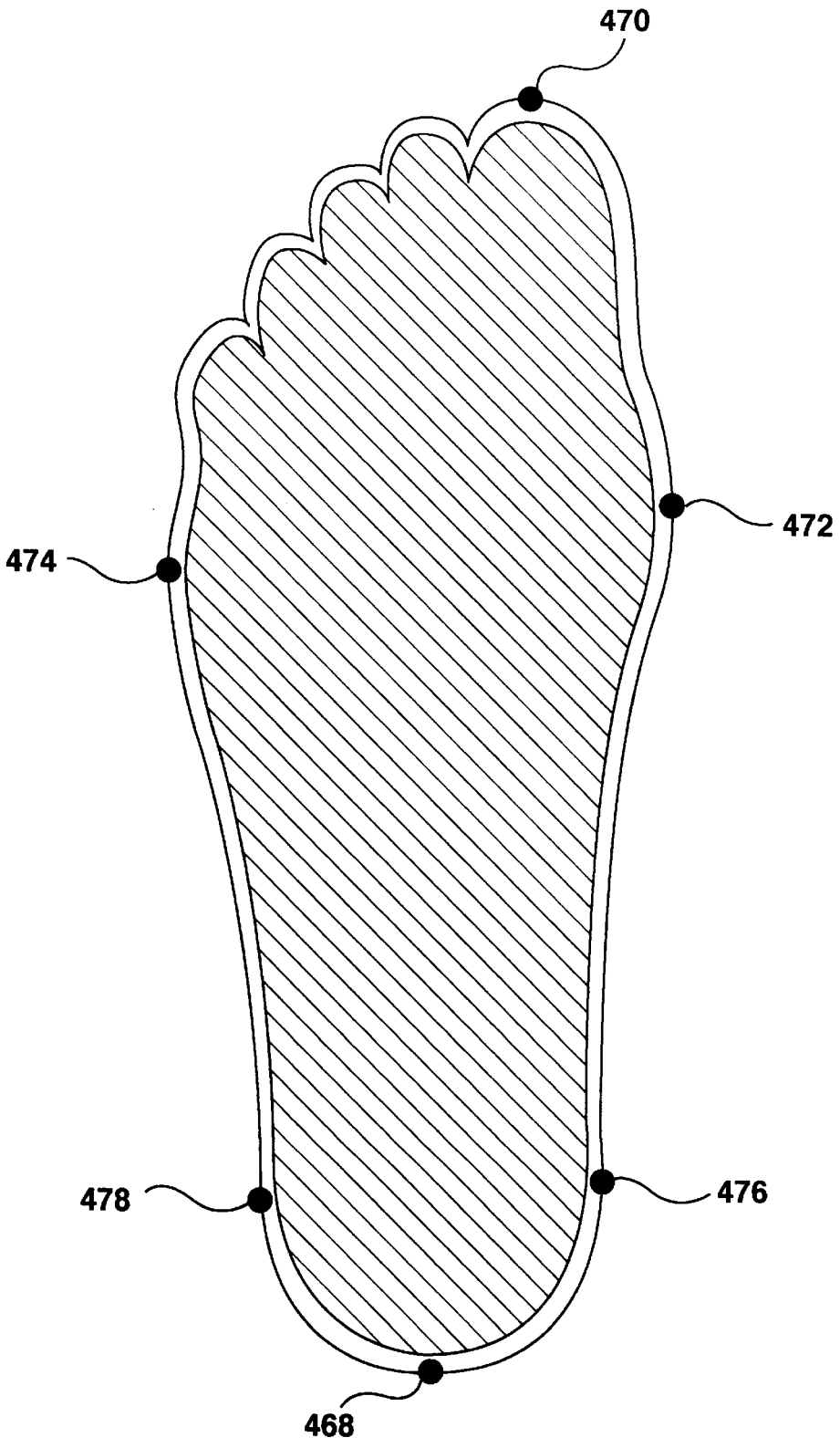
FIG. 13 is a plan view of a scanned foot image.

Reference is now made to FIG. 13, which shows an example of the scanned foot image 438. Foot image 438 includes a foot portion 464 and a background portion 466. Foot portion 464 includes a series of points including a rearmost point 468, a forwardmost point 470, a ball point 472, a width point 474, a right heel point 476 and a left heel point 478, which correspond to rearmost point 66, forwardmost point 67, ball point 68, width point 69, rightmost heel point 70 and leftmost heel point 71 of foot 32. Foot image 438 is, in fact, received by program 430 as a digital map 480 of discrete elements, each having a greyscale value, where a greyscale value of 0 is equal to the colour black and a greyscale value of 255 is a value of white.

Referring to FIG. 12, program 430 receives digital map 480 and sends map 480 to an edge detection subroutine 482 that determines the portion of map 480 corresponding to foot portion 464 by searching for all map elements having greyscale values below a certain set point, such as 240. Edge detection subroutine 482 also determines if there is any rotational misalignment of map 480, due to user 412 having placed their foot 432 incorrectly aligned on the scanner face. Subroutine 482 then determines a series of point data including a rearmost point datum 484, a forwardmost point datum 486, a ball point datum 488, a width point datum 490, a right heel point datum 492 and a left heel point datum 494, which correspond to rearmost point 468, forwardmost point 470, ball point 472, width point 474, rightmost heel point 476 and leftmost heel point 478 of foot portion 464 of scanned image 438.

Program 430 then sends the determined point data to a dimension calculating subroutine 496, which calculates a scanned foot length datum 498, a scanned foot metatarsal length datum 500, a scanned foot width datum 502 and a scanned heel width datum 504, which correspond to lengths and widths 73, 74, 75 and 76 of foot 32.

Program 430 then stores data 498, 500, 502 and 504 in a user information database 506 with user information 508, and executes comparison module 462, which is similar to comparison module 36. Module 462 receives foot dimensions 498, 500, 502 and 504 as well as sock-type indicator 510, a fit-type indicator 512 and shoe selection indicator 514 indicating selected shoe 426. Module 462 then draws in shoe data 516, 518, 520 and 522 and outputs to user 12 fit indicators 524, 526, 528 and 530 on monitor 526 (shown in FIG. 11) which indicate the predicted fit of selected shoe 426.

Figure 14:
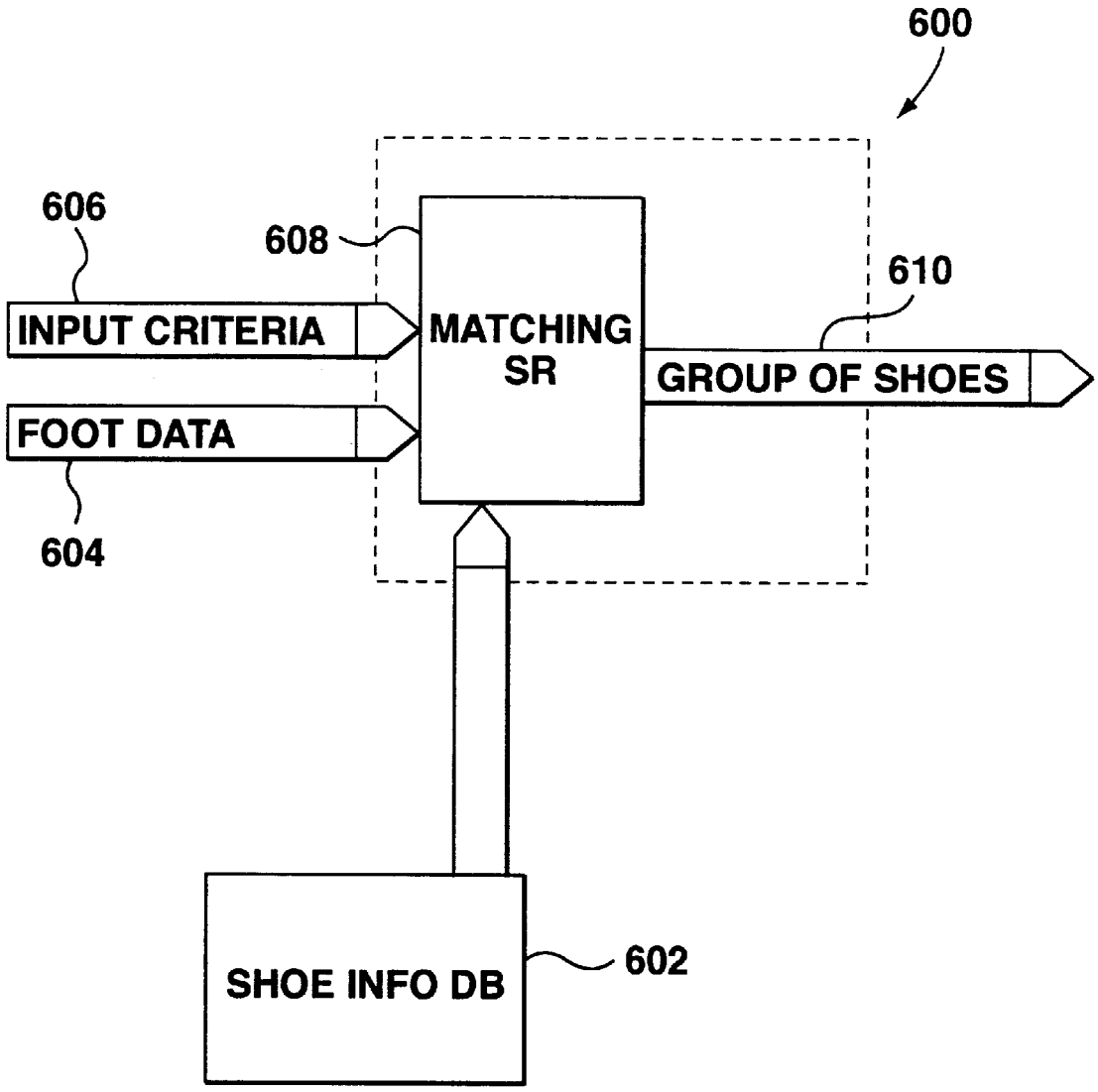
FIG. 14 is a block diagram of an alternate comparison module.

Reference is now made to FIG. 14, which shows an alternate comparison module 600, which can be used with any of the previous foot data modules 34 or 460. Comparison module 600 is used to scan through a shoe information database 602, and determine all the shoes in database 602 that meet a set of input criteria 604, which are inputted by a user. Thus, aside from receiving foot data 606 from a foot data module (not shown), comparison module 600 can receive from a user, input criteria 604, such as shoe colour, shoe style (eg. pump) and heel elevation. Comparison module 600 sends input criteria 604 and the foot data 606 to a matching subroutine 608 to determine a group 610 of shoes in database 602 that match the criteria 604, while also providing at least an acceptable fit for all fit indicators, using a fitting process similar to that used in comparison modules 36 and 462. Module 600 then outputs group 610 of matching shoes to the user, using a monitor (not shown), or some other output device.

While it is particularly advantageous to a user for database 130 to include data for shoes 14 from several different makes and models, database 130 can alternately include data only for a single make or a single model of shoe.

Other data on foot 32 can alternately be measured and inputted into a program for the purpose of shoe sizing, such as the height of the arch portion and the ankle height.

Other data can alternately be measured for shoes 14 and stored in database 130, for use in calculating an effective length for shoes 14. Such data include the thickness of the upper material, the length and positioning of the opening.

Other criteria can alternately be used for the determination of the fit indicators for a selected shoe on the foot of a user.

While program 30 is designed only to receive the leftmost and bottommost edges 344 and 348 of card 340, a program may alternately be designed to receive data on the rightmost and topmost edges 342 and 346 of card 340, so that card 340 can be placed anywhere within measurement area 306. Furthermore, while it has been shown to use a credit or financial institution card 340 for normalizing the foot data, any object having at least one known dimension can be used, so long as the dimension can be measured using the horizontal graduations 308, and measured using the vertical graduations 310.

Data that are calculated for shoe 94 by program 30 can alternately be calculated by another program and stored in database 130, so that program 30 has less work to do.

Rather than having a high-weight bearing scanning surface 450 and housing 452, scanner 422 can alternately have a standard scanning surface and a standard housing as used on a standard scanner, such as an HP Scanjet II™. In this case, the user can place their foot on the scanning surface without putting so much weight on the surface as to damage the scanner.

While it has been shown that scanner 422 is connected to computer 420 by cable 424, scanner 422 can be connected to a separate computer, by a cable similar to cable 424. The separate computer can then be connected to computer 420 by a network connection such as the Internet. In this way, a user can scan their selected foot at home, using a standard flatbed scanner, such as an HP Scanjet II™, and transmit the scanned foot image to computer 420 for the selection of shoes.

While it has been shown for horizontal graduations 308 to be used for both the measurement of foot 32 and card 340, a separate first set of horizontal graduations can alternately be included on chart 300 for measuring foot 32, and a separate second set of horizontal graduations can be included on chart 300 for measuring card 340. Similarly, vertical graduations 310 can be replaced by a separate first set of vertical graduations and a separate second set of vertical graduations for measuring foot 32 and card 340 respectively.

While it is preferable for comparison modules 36 and 600 to receive data on the type of fit that the user desires a module can alternately function without receiving input from a user on a selected type of fit.

Using a shoe-sizing system made in accordance with the present invention is a fast and convenient way of assessing the fit of a shoe, and of selecting a shoe that-fits well from amongst a plurality of makes, models and sizes. It also provides a way for a person to quickly assess the fit of a shoe remotely, say, from home. This enables a person to purchase shoes remotely, say, over the Internet, with an increased degree of confidence that the purchased shoes will fit.

As will be apparent to persons skilled in the art, various modifications and adaptations of the systems and methods described above are possible without departure from the present invention, the scope of which is defined in the appended claims.

I claim:

1. A method for determining the fit of a selected shoe on a selected foot, comprising:

obtaining a set of foot measurements for the selected foot, the set of foot measurements including foot length;

obtaining a set of shoe measurements for the selected shoe, the set of shoe measurements including shoe length, wherein the shoe measurements are independent of any shoe size provided by the manufacturer of the selected shoe;

comparing the shoe measurements with the foot measurements; and generating at least one fit indicator based on the comparison.

2. A method as claimed in claim 1, wherein the step of obtaining foot measurements comprises:

providing a scanner;

obtaining a scanned foot image using the scanner; and determining the foot measurements from the scanned image.

3. A method as claimed in claim 1, wherein the shoes and the foot are remote from each other.

4. A method as claimed in claim 2, wherein the scanner is adapted to support the weight of a person.

5. A method as claimed in claim 1, wherein the set of foot measurements includes foot heel width and the set of shoe measurements includes shoe heel width.

6. A method as claimed in claim 1, wherein the set of foot measurements includes foot metatarsal length and the set of shoe measurements includes shoe metatarsal length.

7. A method as claimed in claim 1, wherein the set of foot measurements includes foot width and the set of shoe measurements includes shoe width.

8. A method as claimed in claim 1, wherein the set of foot measurements includes a sock-thickness value, and the method further comprises amending the foot length based on the sock thickness value.

9. A method as claimed in claim 1, wherein the set of shoe measurements includes shoe collar thickness and the method further comprises amending the shoe length based on the shoe collar thickness.

10. A method for determining an actual foot measurement for a selected foot of a user, the user having a foot sizing chart image that is printed at an unspecified printing scale to produce a foot sizing chart having an unspecified chart scale in a scale direction, the method comprising:

receiving from the user, a chart measurement on the foot sizing chart of the selected foot, wherein the first chart measurement of the selected foot is in the scale direction;

receiving from the user, a chart measurement on the foot sizing chart of a predetermined object having a known dimension, wherein the chart measurement of the predetermined object is in the scale direction; and multiplying the chart measurement of the selected foot by the ratio of the known dimension of the predetermined object to the chart measurement of the predetermined object, thereby obtaining the actual foot measurement.

11. A method as claimed in claim 10, wherein the predetermined object is a credit card.

* * * * *

UNITED STATES PATENT AND TRADEMARK OFFICE

CERTIFICATE OF CORRECTION

PATENT NO. : 6,550,149 B2
APPLICATION NO. : 09/844676
DATED : April 22, 2003
INVENTOR(S) : Mark Dowdell It is certified that error appears in the above-identified patent and that said Letters Patent is hereby corrected as shown below:

At column 4, line 53, delete “metatarsal length 74” and replace with --width 75--; and At column 4, line 55, delete “width 75” and replace with --metatarsal length 74--.

Signed and Sealed this

Twenty-fourth Day of June, 2008

JON W. DUDAS
*Director of the United States Patent and Trademark Office*